United States Patent [19]

Kleefeldt et al.

[11] Patent Number: 4,895,009

[45] Date of Patent: Jan. 23, 1990

[54] DOOR-LOCKING SYSTEM FOR A MOTOR VEHICLE

[75] Inventors: Frank Kleefeldt, Heiligenhaus; Peter Bartel, Hattingen/Buhr, both of Fed. Rep. of Germany

[73] Assignee: Kiekert GmbH & Co. Kommanditgesellschaft, Heiligenhaus, Fed. Rep. of Germany

[21] Appl. No.: 267,385

[22] Filed: Nov. 4, 1988

[30] Foreign Application Priority Data

Nov. 5, 1987 [DE] Fed. Rep. of Germany ..... 3737468

[51] Int. Cl.[4] ..... E05B 53/00

[52] U.S. Cl. ..... 70/264; 70/238; 70/256; 70/277

[58] Field of Search ..... 70/238, 256, 263, 264, 70/265, 275, 277; 340/825.31

[56] References Cited

U.S. PATENT DOCUMENTS

| | | | |
|---|---|---|---|
| 4,364,249 | 12/1982 | Kleefeldt | 70/264 |
| 4,637,239 | 1/1987 | Kleefeldt et al. | 70/264 |
| 4,719,460 | 1/1988 | Takeuchi et al. | 70/256 X |
| 4,787,223 | 11/1988 | Gotanda | 70/264 |
| 4,827,744 | 5/1989 | Namazue et al. | 70/256 X |
| 4,835,533 | 5/1989 | Akutsu | 70/256 X |
| 4,837,567 | 6/1989 | Kleefeldt et al. | 70/256 X |

FOREIGN PATENT DOCUMENTS

| | | | |
|---|---|---|---|
| 0078962 | 5/1983 | European Pat. Off. | 70/263 |
| 2911630 | 10/1980 | Fed. Rep. of Germany . | |
| 2911680 | 10/1980 | Fed. Rep. of Germany . | |
| 2923505 | 12/1980 | Fed. Rep. of Germany | 70/264 |
| 3031066 | 6/1982 | Fed. Rep. of Germany . | |
| 3237622 | 4/1984 | Fed. Rep. of Germany | 70/277 |
| 3244855 | 6/1984 | Fed. Rep. of Germany | 70/264 |
| 2922431 | 7/1984 | Fed. Rep. of Germany . | |
| 3244049 | 9/1984 | Fed. Rep. of Germany . | |
| 3120222 | 1/1985 | Fed. Rep. of Germany . | |
| 3324956 | 1/1985 | Fed. Rep. of Germany | 70/256 |
| 3334049 | 4/1985 | Fed. Rep. of Germany | 70/256 |
| 2936402 | 3/1986 | Fed. Rep. of Germany . | |
| 3442356 | 5/1986 | Fed. Rep. of Germany | 70/264 |
| 3443288 | 6/1986 | Fed. Rep. of Germany . | |
| 3510102 | 10/1986 | Fed. Rep. of Germany | 70/264 |
| 3300732 | 9/1987 | Fed. Rep. of Germany . | |
| 2514306 | 4/1983 | France | 70/256 |
| 2131992 | 6/1984 | United Kingdom | 70/264 |
| 2133073 | 7/1984 | United Kingdom | 70/264 |

*Primary Examiner*—Gary L. Smith
*Assistant Examiner*—Suzanne L. Dino
*Attorney, Agent, or Firm*—Herbert Dubno

[57] ABSTRACT

The door-lock system for a motor vehicle has mechanical motor vehicle door locks in all motor vehicle doors and the trunk lid, a mechanical lock cylinder in the motor vehicle door lock of the driver's door and a remotely operable electronic operating mechanism with a transmitter acting as an electronic key, a receiver and decoder as well as a power supply. The motor vehicle door locks in the doors have at least one locked configuration and an additional theft preventative configuration as well as a central lock mechanism drive with control positions for engagement and/or disengagement of the theft preventative configuration. The central lock mechanism drive is operable by the electronic operating mechanism. The decoder and the receiver of the electronic operating mechanism are independent components which are connected only electrically. The receiver is located otside, e.g. in the driver's door, and only operates from the outside by a transmitter. The decoder is located in the inside of the motor vehicle and is connected electrically with the central lock mechanism drive. Moreover, an emergency operating device is provided for disengagement of the theft preventative mechanism.

3 Claims, 1 Drawing Sheet

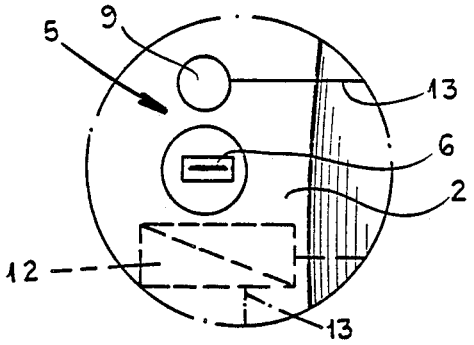
FIG.2
FIG.1
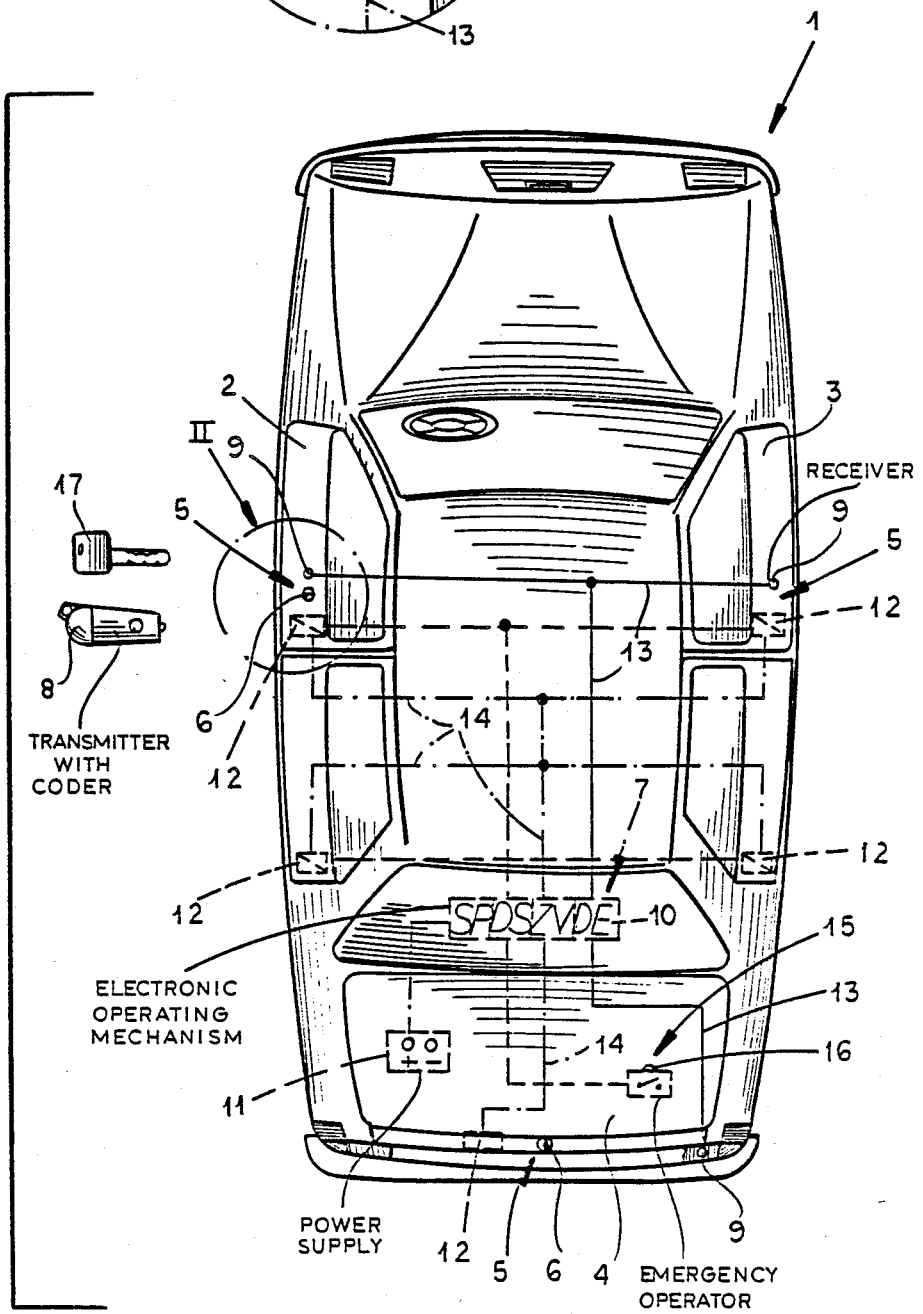

DOOR-LOCKING SYSTEM FOR A MOTOR VEHICLE

CROSS-REFERENCE TO RELATED APPLICATIONS

This application is related to the following commonly owned copending applications: Ser. No. 07/013,196 filed Feb. 9, 1987, Ser. No. 06/888,148 filed July 18, 1986, Ser. No. 07/072,055 filed July 10, 1987, Ser. No. 07/097,226 filed Sept. 15, 1987, Ser. No. 07/218,237 filed July 12, 1988, Ser. No. 07/218,238 filed July 12, 1988 and Ser. No. 07/203,245 filed June 6, 1988.

FIELD OF THE INVENTION

Our present invention relates to a motor vehicle door-locking system, especially for a motor vehicle with a plurality of motor vehicle doors and a trunk lid.

BACKGROUND OF THE INVENTION

A door-locking system for a motor vehicle with motor vehicle doors and a trunk lid can have a mechanical motor vehicle door lock in each of the motor vehicle doors and in the trunk lid, a mechanical lock cylinder in the door lock of the driver's door and a remotely controllable electronic operating device with a transmitter as an electronic key, a receiver and decoder and a power supply.

The door locks in the motor vehicle doors have at least one locked configuration and an additional theft preventative configuration.

The motor vehicle door locks have a central lock mechanism drive with control positions for engagement and/or disengagement of the theft preventative configuration and the central lock mechanism drive is operable by the electronic operating device.

In this door-lock system the motor vehicle door locks in the motor vehicle doors can be locked and unlocked mechanically from the inside so that the motor vehicle doors can be opened in any event from the inside.

The theft preventative mechanism can not be deactivated understandably from the inside, because if it could be so deactivated, the thief could break in a motor vehicle window pane of the theft protected vehicle and disengage the theft preventative configuration.

In the known motor vehicle door-lock system on which our invention is based the decoder and the receiver form a single unit which is mounted in the inside of the motor vehicle. Should the driver climb in the motor vehicle and accidentally operate the transmitter, i.e. the electronic key, the theft preventative mechanism would be engaged and could not be shut-off mechanically from the interior in case of danger. That impairs the security of the driver and possibly the passenger.

In particular from the state of the art and historically, the following should be noted: Door lock systems for motor vehicles with a central lock mechanism and if necessary special motor vehicle door lock mechanisms are known to have different forms.

Particularly, there are lock systems in which a special theft preventative configuration is possible as well as the standard locked and unlocked configuration (compare German Pat. Nos. 29 11 630, 29 11 680, 30 31 066 and 34 43 287).

The theft preventative configuration causes a positive locking inside the mechanism for central locking so that the standard lock knobs mounted inside in the driver's door and the interior operating mechanism are rendered inoperative. A driver's door equipped then for theft prevention cannot be secured from the inside. The driver's door cannot be opened from the exterior when the motor vehicle door lock is locked.

Should a theft preventative mechanism be engaged from the inside of the motor vehicle, one could, as already mentioned, be prevailed from leaving the motor vehicle in the usual direct way by simple mechanical operation.

To guarantee this type of escape in the past, one operated the standard mechanical lock cylinder, e.g. for door disengagement in the motor vehicle door, for disengagement and engagement of the theft preventative mechanism.

The mechanism can be designed so that in a locking displacement or motion in the lock cylinder the central lock mechanism goes into the theft preventative configuration.

In practice, however, differences can appear between the standard locked configuration and the theft preventative configuration in operation of this lock cylinder, especially in cases where large control displacements must be performed. Thus a special lock cylinder was developed (compare German Pat. Nos. 29 22 431, 29 36 402 and 31 20 222).

More recently, however, the mechanical lock cylinder for operation of a central lock mechanism and for engagement or disengagement of the theft preventative configuration was replaced by an electronic remotely operated door lock system (German Pat. Nos. 32 44 049 and 33 00 732). This door-lock system comprises, in everyday application, one or more transmitters, i.e. electronic keys, and a receiver with a decoder, which is placed in the motor vehicle interior. Then the problems described are present.

OBJECT OF THE INVENTION

It is an object of our invention to provide an improved motor vehicle door-lock system in which an engagement of the theft preventative configuration by accidental operation of the transmitter by a person who has entered the motor vehicle and inadvertently operates the transmitter is prevented.

SUMMARY OF THE INVENTION

These objects and others which will become more readily apparent hereinafter are attained, in accordance with our invention, in a motor vehicle door-lock system with a standard locked and unlocked configuration as well as at least one theft preventative configuration comprising a mechanical lock cylinder and a remotely operated electronic operating mechanism with a transmitter and a receiver and decoder.

According to our invention, the decoder and the receiver of the electronic operating device are independent components which are connected only electrically. The receiver is located outside, e.g. in the driver's door, and is operable only from the outside by the transmitter. The decoder is located in the interior of the motor vehicle and is connected electrically with the central lock mechanism. Moreover an emergency device for disengagement or release of the theft preventative configuration is provided.

Emergency operation is required to make the motor vehicle accessible when the theft preventative configuration is engaged, if the electronic operating mechanism fails to work because of some reason. An especially advantageous embodiment of our invention is characterized by the decoder being associated with several receivers of which (besides the receiver in the driver's side) one is positioned exteriorly in the passenger's door and another is located exteriorly in the vicinity of the trunk lid.

The emergency operation can occur in different ways, e.g. using a suitable special lock cylinder. One can also have a situation in which the power supply for the receiver and the associated units is omitted and electrical contacts can be provided so that external power can be supplied by an external power supply. Thus there can be a power supply in the transmitter and electrical contacts can be located in the transmitter on the one hand and on the other hand in the receivers.

Also, a central lock unit could be equipped as an emergency power supply unit.

According to another feature of our invention, the emergency operating device operates electronically on the central lock mechanism drive and is provided with a theft preventative mechanism disengagement switch. Thus the theft preventative mechanism disengagement switch can be located in the space closed by the trunk lid which has a motor vehicle door lock with a central lock mechanism drive but which cannot take the theft preventative configuration so that this motor vehicle door lock is operable also by a mechanical key.

BRIEF DESCRIPTION OF THE DRAWING

The above and other objects, features and advantages of our invention will become more readily apparent from the following highly diagrammatic description, reference being made to the accompanying drawing in which:

FIG. 1 is a top plan view of the door locking system according to our invention installed in an automobile; and FIG. 2 is a detailed top view of the portion II of the door-locking system of FIG. 1 indicated by the dot-dashed circle in FIG. 1.

SPECIFIC DESCRIPTION

The body 1 of a four-door motor vehicle is shown in the drawing to have two motor vehicle doors 2, 3 for the driver and passenger and a trunk lid 4. The door-locking system according to our invention comprises mechanical motor vehicle door locks 5 in all motor vehicle doors 2, 3, etc. and in the trunk lid 4, a mechanical lock cylinder 6 in the motor vehicle door lock 5 of the driver's door 2 and a remotely operable electronic operating mechanism 7.

At least one transmitter 8 which is coded to act as an electronic key, a receiver 9 with a decoder 10 and a power supply 11 are part of this electronic operating mechanism 7. The design is such that the motor vehicle door locks 5 in the motor vehicle doors 2, 3 have at least one locked configuration and at least one additional theft preventative configuration as well as a central lock mechanism drive 12 with control positions for engagement and/or disengagement of the theft preventative configurations.

Usually the motor vehicle door locks 5 have two locked configurations, namely, a preliminary locked configuration and a main locked configuration. The central lock mechanism drives 12 are to be operated by the remotely operable electronic operating mechanism 7. The decoder 10 and the receivers 9 of the electronic operating mechanism 7 are independent components. They are only electrically connected by the conductor 13.

A receiver 9 is located outside in the vehicle door 2 and is acted on from the outside only by the transmitter 8. The decoder 10 is located in the inside of the motor vehicle and is electrically connected by the conductor 14 with the central lock mechanism drives 12.

Moreover, an emergency operating device 15 for disengagement of the theft preventative configuration is provided. In this example the decoder 10 is attached with several receivers 9, of which one, as already mentioned, is located in the motor vehicle driver's door 2, another outside in the passenger door 3 and still another outside in the vicinity of the trunk lid 4, e.g. in a tail light.

The emergency operating device 15 operates electrically on the central lock mechanism drive 12 and has a theft preventing mechanism disengagement switch 16. The theft preventing mechanism disengagement switch 16 is located in this example in the space closed by the trunk lid 4. The trunk lid 4 has a motor vehicle door lock 5 with a central lock mechanism drive 12 which however cannot take a theft preventative configuration. This motor vehicle door lock 5 in the trunk lid 4 is also operated with a mechanical key so that the theft preventative mechanism disengagement switch 16 is easily accessible on breakdown or failure of the electronic operating mechanism of the different motor vehicle door locks 5. It is understood that it can be operated only with a special key.

The door-lock system as a whole fulfills the following different functions:

First, the motor vehicle can be locked and unlocked with a mechanical key 17 by the mechanical lock cylinder 6 in the driver's door 2. With the mechanical key 17 the trunk lid 4 can be locked and unlocked also by the mechanical lock cylinder 6 in the motor vehicle door lock 5 of the trunk lid 4. The latter may be independent of whether door-lock system of the motor vehicle as a whole is in the locked configuration or in the theft preventative configuration. By lock knobs (not shown) the motor vehicle can be locked and unlocked from the inside as long as the door-lock system is not located in the theft preventative configuration. It cannot be located in this theft preventative configuration from the motor vehicle inside or interior compartment.

The theft preventative mechanism is engaged or disengaged when the transmitter 8 of the electronic operating mechanism 7 is operated. Only the motor vehicle door locks 5 in the side doors 2, 3 (there may be two or four side doors) and/or the central lock mechanism drive 12 of these motor vehicle door locks 5 can be located in a theft preventing configuration.

In the transmitter and/or in the transmitters 8, i.e. in the electronic keys, an optical or acoustic signal light is usually provided, which can detect whether the battery in the individual transmitters 8 is still behaving properly or must be replaced.

If a prompt battery change is not made and the door-lock system of the motor vehicle is accidentally in the theft preventative configuration, thus the trunk lid 4 can be opened with a mechanical key 17 and the theft preventative configuration, as previously described, can be released or disengaged by the theft preventative mechanism disengagement switch 16. On the other hand if the power in the motor vehicle fails and the door-lock system of the motor vehicle is in the theft preventative configuration, a power determination occurs in the motor vehicle in operation and the central lock mechanism drive 12 in the driver's door 2 is moved from the theft preventative configuration to the only locked configuration.

We claim:

1. In a door-closing system for a motor vehicle having a trunk lid and a plurality of motor vehicle doors comprising a mechanical motor vehicle door lock in each of said motor vehicle doors and in said trunk lid, a mechanical lock cylinder in said door lock of the driver's door of said motor vehicle doors and a remotely controllable electronic operating device with a transmitter acting as an electronic key, a receiver and decoder and a power supply, said motor vehicle door locks in said motor vehicle doors having at least one locked configuration and an additional theft preventative configuration and a central lock mechanism drive with control positions for engagement and/or disengagement of said theft preventative configuration and said central lock mechanism drive being operable by said electronic operating device, the improvement wherein said decoder and said receiver of said electronic operating device are independent components which are connected only electrically so that said receiver is located outside in said driver's door, and is operable only from said outside by said transmitter, said decoder is located in the interior of said motor vehicle and is connected electrically with said central lock mechanism drive and an emergency device for disengagement or release of said theft preventative configuration is provided, said emergency device operating electrically on said central lock mechanism drive and having a theft preventative mechanism disengaging switch, said theft preventative mechanism disengaging switch being located in a space closed by said trunk lid which has one of said motor vehicle door locks with one of said central lock mechanism drive which cannot take one of said theft preventative configurations and is operable by a mechanical key.

2. The improvement according to claim 1 wherein said decoder is combined with a plurality of said receivers of which in addition to said receiver in said driver's door including a receiver located outside in the passenger door of said motor vehicle doors and another is located outside in the vicinity of said trunk lid.

3. A door-closing system for a motor vehicle having a plurality of motor vehicle doors and a trunk lid comprising:

a mechanical motor vehicle door lock for each of said motor vehicle doors and said trunk lid having at least one locked configuration and an additional theft preventative configuration;

a mechanical lock cylinder in said motor vehicle door lock of the driver's door of said motor vehicle doors;

a remotely controllable electronic operating device having a transmitter acting as an electronic key, a plurality of receivers and a separate decoder independent of said receivers and a power supply, an additional central lock mechanism drive with control positions for engagement and/or disengagement of said theft preventative configuration operable by said electronic operating device also being provided, one of said receivers being located outside, e.g. in said driver's door, and being operable only from said outside by said transmitter, said decoder being located in the interior of said motor vehicle and connected electrically with said central lock mechanism drive, another of said receivers being located outside in the passenger door of said motor vehicle doors and still another of said receivers being located in the vicinity of said trunk lid; and an emergency device for disengagement or release of said theft preventative configuration operating electrically on said central lock mechanism drive and having a theft preventative mechanism disengaging switch mounted in a space closed by said trunk lid which has said motor vehicle door lock with one of said central lock mechanism drives which cannot take one of said theft preventative configurations and is operable by mechanical key.

* * * * *